US006571787B2

(12) United States Patent
Remaklus

(10) Patent No.: US 6,571,787 B2
(45) Date of Patent: Jun. 3, 2003

(54) KISSER BUTTON, PARTICULARLY FOR SHORTER ARCHERY BOWS

(76) Inventor: Roger P. Remaklus, 344 Sidney St., Dundee, MI (US) 48131

( * ) Notice: Subject to any disclaimer, the term of this patent is extended or adjusted under 35 U.S.C. 154(b) by 0 days.

(21) Appl. No.: 09/805,013

(22) Filed: Mar. 12, 2001

(65) Prior Publication Data

US 2002/0124840 A1 Sep. 12, 2002

(51) Int. Cl.[7] ..... F41G 1/467
(52) U.S. Cl. ..... 124/87; 124/90
(58) Field of Search ..... 124/87, 90, 91, 124/92

(56) References Cited

U.S. PATENT DOCUMENTS

| | | | | | |
|---|---|---|---|---|---|
| 2,617,402 | A | * | 11/1952 | Roemer | |
| 3,038,262 | A | | 6/1962 | Fuehrer et al. | 33/180 |
| 3,059,629 | A | * | 10/1962 | Stinson | |
| 3,088,212 | A | | 5/1963 | Smith | 33/180 |
| 3,111,772 | A | | 11/1963 | Hartog | 33/180 |
| 3,584,615 | A | * | 6/1971 | Stinson | |
| 3,600,814 | A | | 8/1971 | Smith | 33/180 R |
| 3,969,825 | A | | 7/1976 | Mathes | 33/180 R |
| 4,116,194 | A | * | 9/1978 | Topel | 124/87 |
| 4,539,970 | A | | 9/1985 | Griz | 124/90 |
| 5,347,976 | A | * | 9/1994 | Saunders | 124/87 |
| 5,666,938 | A | | 9/1997 | Simonds | 124/90 |
| 5,762,059 | A | * | 6/1998 | Strope | 124/87 |

* cited by examiner

*Primary Examiner*—John A. Ricci
(74) *Attorney, Agent, or Firm*—Gifford, Krass, Groh, Sprinkle, Anderson & Citkowski, PC

(57) ABSTRACT

An improved kisser button enables an archer to establish a more accurate shot in conjunction with a smaller anchor point reference. In contrast to exiting devices, wherein the angle formed by the plane of the button and the bowstring is substantially perpendicular, the same angle associated with the inventive unit is purposefully non-perpendicular to accommodate shorter bows, including compound bows. Depending upon the configuration, the angle between the axis of the bore through the button and the plane of the plane of the button is preferably in the range of 10 to 60 degrees, and most preferably at an angle of approximately 45 degrees. The preferred embodiment also includes a thin sleeve protruding from at least one surface of the body through which the bore extends, and a crimp which fits over the sleeve to hold the body in place on the bow string. A slit may be preferably provided through the device, facilitating the ease installation on the string of the bow once strung.

15 Claims, 2 Drawing Sheets

KISSER BUTTON, PARTICULARLY FOR SHORTER ARCHERY BOWS

FIELD OF THE INVENTION

This invention relates generally to string-mounted devices that improve an archer's accuracy and, in particular, to a kisser button more suited to shorter bows, including compound bows.

BACKGROUND OF THE INVENTION

It is well known in ballistics that trajectory must be adjusted with target distance. This is particularly critical to archery, since the relatively low velocity of an arrow may require a very high trajectory for a long shot. Accordingly, numerous devices have been invented to help an archer predict a required level of elevation to reach the mark.

One such device to improve accuracy is the sight pin, which is mounted on the bow and moved vertically to form an angle between the arrow and the archer's line of sight. To the wide variety of available archer equipment, sight pins are adjusted by the shooter, with the finest calibration often being supplied through a memory of particular shooting conditions. Alternatively, multiple sight pins can be used but, again, the archer is required to remember which pin to use for a particular set of circumstances.

In addition to the bow-mounted devices, string-mounted devices are available to assist an archer in determining a proper "anchor point" when the bowstring is fully drawn. A consistent anchor point is typically used in conjunction with some form of bow-mounted sighting device to establish a consistent set of relationships enabling an accurate, repeatable shot. One device that is commonly used to establish a repeatable anchor point is the "kisser button," an object that receives its name from the fact that with the string fully drawn, the edge of the button typically makes contact with the archer in the crease between the upper and lower lips.

With existing kisser buttons, the bowstring passes through the center of the button and perpendicular to it. This offers the advantage that the orientation of the kisser button is unaffected by twisting of the bowstring, but presents certain disadvantages as well. One disadvantage has evolved with the advent of shorter modem bows and their increased bow string angle at full draw, causing its increased profile to make contact with the archer's face, thereby reducing its effectiveness at determining the precise anchor point.

As shown in FIGS. 1A and 1B, with non-compound or long bow 102, the angle 103 formed by the string when fully drawn is not that pronounced, such that the kisser button 104, located slightly above the archer's grip, is still relatively close to remaining in a horizontal plane, with the bow 102' fully drawn. As such the angle 106' formed by the plane 106 of the button 104 is sufficiently low that the edge of the kisser button locates fairly precisely at the archer's anchor point.

As shown in FIGS. 2A and 2B, with shorter bows, however, particularly compound bows 202 and 202', the angle 203 formed by the string when fully drawn is much more pronounced, such that the existing kisser button 204 form an angle 206' of around 45 degrees relative to plane 106, thereby precluding the archer's ability to accurately place the edge of the button at an exact anchor point.

The need remains, therefore, for a kisser button that is oriented closer to horizontal when the string of a shorter bow such as a compound bow, is fully drawn so that only the smallest possible profile makes facial contact. This more precisely locates the archer's anchor point, thereby improving accuracy.

SUMMARY OF THE INVENTION

This invention resides in a bow string mounted object, commonly called a kisser button, which enables an archer to establish a more accurate shot by touching the object to a point on the face when the bow is fully drawn. Similar to existing devices, the inventive kisser button preferably assumes the form of a flattened disk defining a plane through which the bowstring protrudes. In contrast to exiting devices, however, wherein the angle formed by the plane of the disk and the bowstring is substantially perpendicular, the same angle associated with the inventive unit is purposefully non-perpendicular to accommodate shorter bows, including compound bows.

Depending upon the configuration, the angle between the axis of the bore through the button and the plane of the plane of the button is preferably in the range of 10 to 60 degrees, and most preferably at angles of 35 to 55 degrees. Although a button according to the invention may assume any shape, be it geometric or symmetrical, in the preferred embodiment the body is a flattened disk, preferably having an outer diameter of approximately one-half inch.

The preferred embodiment may also include a thin, flexible or resilient sleeve protruding from at least one surface of the body through which the bore extends. A slit may also be provided through the device, with or without the sleeve, facilitating installation on the string of the bow once strung. A fastener may be provided to hold the button in place. If a sleeve is used, such a fastener may conveniently take the form of a crimp that fits over the sleeve to hold the body in place.

DETAILED DESCRIPTION OF THE INVENTION

Figures 1A, 1B, 2A, 2B:
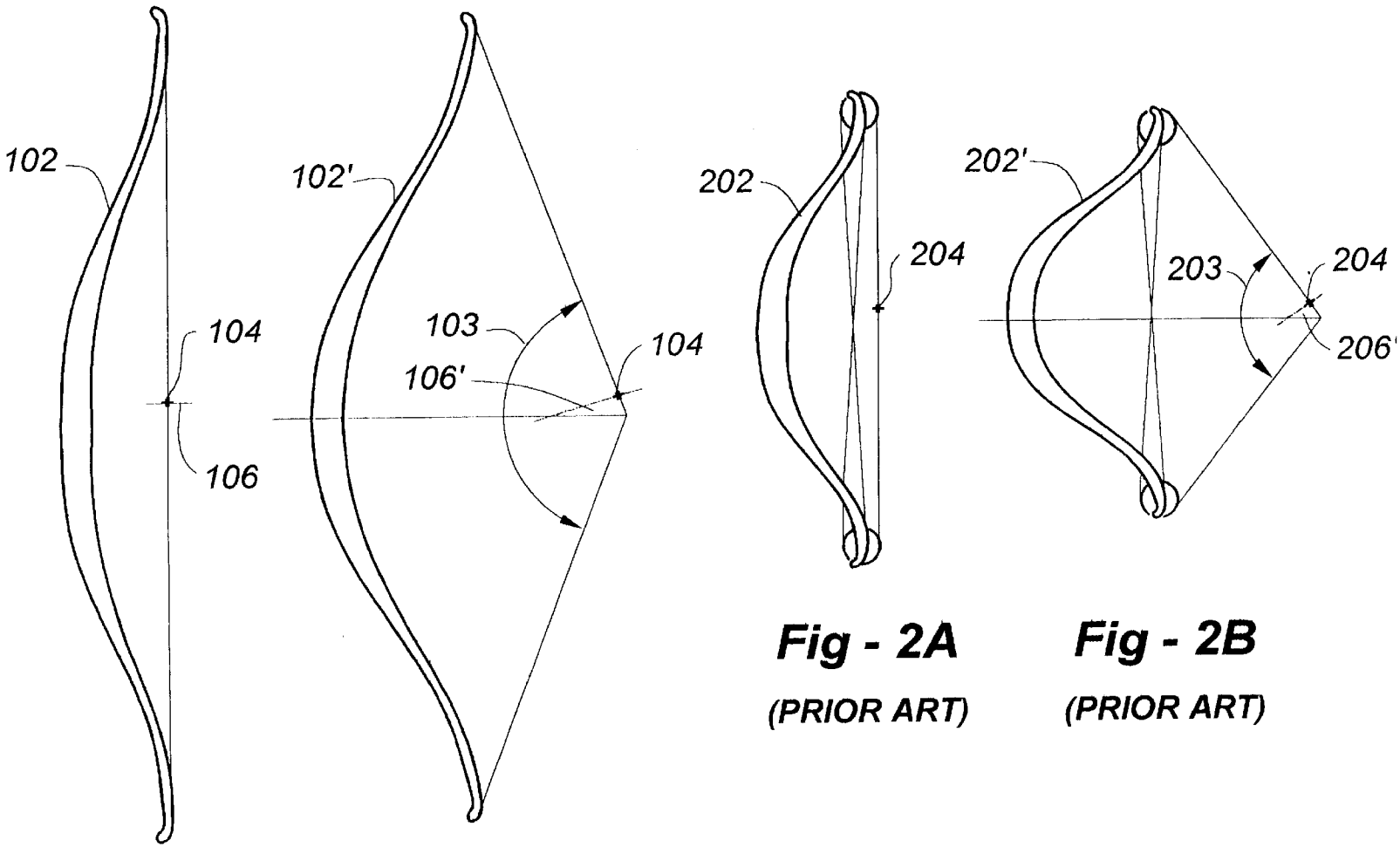
Fig - 2B (PRIOR ART)
Fig - 2A (PRIOR ART)
Fig - 1B (PRIOR ART)
Fig - 1A (PRIOR ART)
FIG. 1A is a simplified drawing of a long bow having a conventional prior-art kisser button attached thereto.
FIG. 1B shows the bow FIG. 1A having been drawn.
FIG. 2A is a drawing of a shorter bow, in this case a compound bow, also having a kisser button attached on the string thereof.
FIG. 2B shows the bow of FIG. 2A having been drawn, showing how, with a conventional kisser button, the angle formed by the plane of the button and a horizontal plane is more puonounced.
Figure 3:
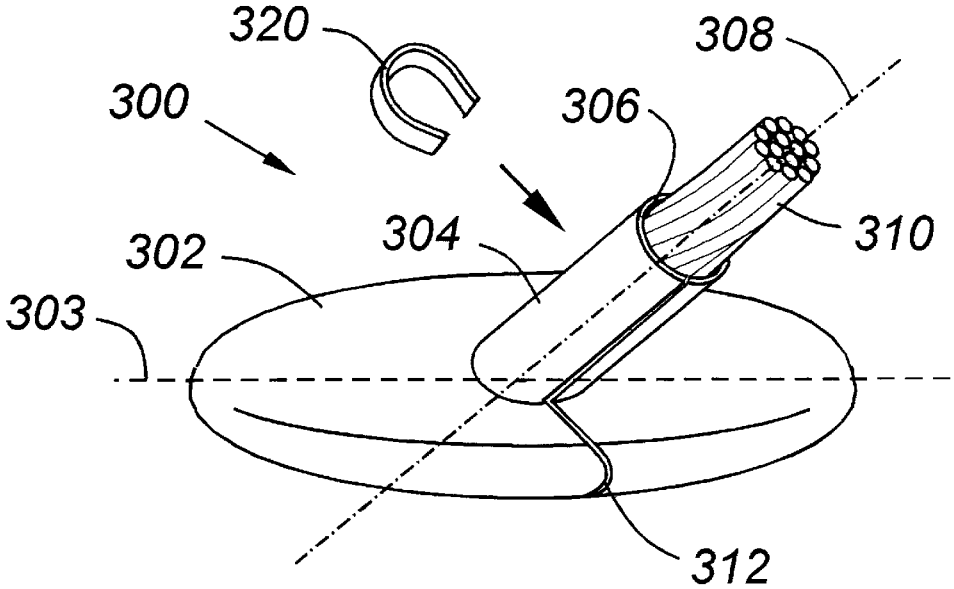
FIG. 3 is an oblique drawing of a kisser button according to the invention, having a central bore with and access which is substantially non-perpendicular to the plane of the buttons.

Having discussed the problems of the prior art with reference to FIGS. 1A through 2B, reference is now made to FIG. 3 which is an oblique drawing of the kisser button according to the invention, shown generally at 300. As with existing devices, the button preferably assumes the shape of a flattened body 302 defining a plane 303, perhaps better seen in FIG. 4. A bore 306, defining an axis 308, extends through the body 302, having an inner diameter size to receive a bowstring 310.

To stabilize the positioning of the button onto the bowstring, a sleeve 304 is preferably provided through which the bore 306 also extends. To facilitate installation of the button onto the bowstring, a slit 312, through the body 302 and sleeve 304 may also be provided, along with a crimp 320 that squeezes the sleeve 304 to hold it tightly onto the bowstring 310.

Figure 4:
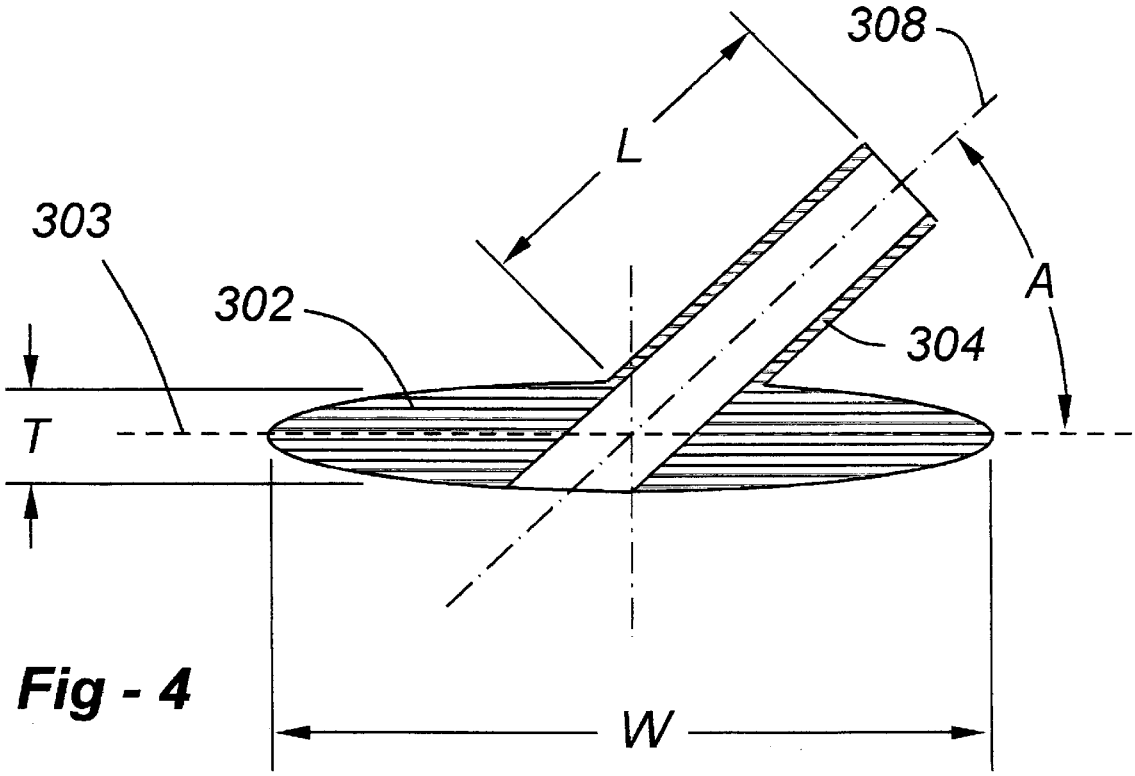
FIG. 4 is a cross-sectional view of a preferred kisser button according to the invention.

In contrast to existing devices and as shown in FIG. 4, the angle A formed by the axis 308 of the bore 306 and the plane of the button 303, is substantially non-perpendicular. A preferred range of angles is from 10 to 60 degrees, most desirable angle being in the range of 35 to 55 degrees, or thereabouts. Referring back to FIG. 2B, with the string of a shorter bow fully drawn, use of the device mounted on the bowstring will result in the plane of the body of the button being much closer to parallel with the ground, thereby enabling the archer to use this parallel alignment in conjunction with other factors to establish a more accurate shot.

The device according to the invention may be constructed from a number of materials, both natural and synthetic. In the preferred embodiment, however, the device is molded from a plastic or polymeric material such as polyethylene, polyurethane, vinyl, hard rubber, or other alternatives. Note that the sleeve 304 is, in fact, optional according to the invention, and may be eliminated if the body of the device is made thick enough to establish an angle with the bowstring on its own. However, with the flattened shape, the sleeve 304 is preferably provided, having a substantially thin wall, such that with the addition 320, the wall of the sleeve 304 will be crimped down and onto the bowstring 310, thereby holding the entire assembly correctly in place.

FIG. 4 is a cross-section of a preferred embodiment of the invention, showing the Angle A with the plane 304 of the device and axis of the bore therethrough. In a preferred configuration, the width W, is on the order of 0.5 inch, though smaller or somewhat larger dimensions may be used. The thickness T is approximately ⅛ inch, and the length L is on the order of 7⁄16 of an inch or thereabouts.

I claim:

1. A kisser button particularly suited to shorter archery bows, including compound bows, the kisser button comprising:

a body defining a plane; and a bore through the body having an axis and internal diameter sized to receive the string of the bow, the angle between the axis of the bore and the plane of the body being substantially non-perpendicular to achieve a parallel alignment to a loaded arrow when the body contacts a user's closed lips with the bow at full draw.

2. The kisser button of claim 1, wherein the angle is in the range of 10 to 60 degrees.

3. The kisser button of claim 2, wherein the angle is in the range of 35 to 55 degrees.

4. The kisser button of claim 1, wherein the body is a flattened disk having an outer diameter.

5. The kisser button of claim 4, wherein the outer diameter of the disk is approximately one-half inch.

6. The kisser button of claim 1, further including a thin sleeve protruding from at least one surface of the body through which the bore extends.

7. The kisser button of claim 6, further including a crimp which fits over the sleeve to hold the body in place on the bow string.

8. The kisser button of claim 1, further including a slit extending from the outer edge of the body to the bore enabling the kisser button to be installed on the string of the bow once strung.

9. The kisser button of claim 1, further including a fastener to hold the body in place on the bow string.

10. A kisser button particularly suited to shorter archery bows, including compound bows, the kisser button comprising:

a flattened disk having an outer diameter and upper and lower surfaces defining a plane;

a thin sleeve protruding from at least one of the upper and lower surfaces; and a bore through the disk and sleeve having an axis and internal diameter sized to receive the string of the bow, the angle between the axis of the bore and the plane of the disk being in the range of 10 to 60 degrees.

11. The kisser button of claim 10, wherein the angle between the axis of the bore and the plane of the disk is in the range of 35 to 55 degrees.

12. The kisser button of claim 10, wherein the outer diameter of the disk is approximately one-half inch.

13. The kisser button of claim 10, further including a crimp which fits over the sleeve to hold the body in place on the bow string.

14. The kisser button of claim 10, further including a slit through the disk and sleeve enabling installation on the string of the bow once strung.

15. The kisser button of claim 10, further including a fastener to hold the disk in place on the bow string.

* * * * *